US007806683B2

(12) United States Patent
Mitxelena et al.

(10) Patent No.: US 7,806,683 B2
(45) Date of Patent: Oct. 5, 2010

(54) SAFETY VALVE SUPPLY CIRCUIT FOR THE IGNITION OF A GAS BURNER

(75) Inventors: José María Mitxelena, Hernani (ES); Jokin Mujika, Eskoriatza (ES); José María Lasa, Oñati (ES)

(73) Assignee: Orkli, S. Coop, Ordizia (ES)

( * ) Notice: Subject to any disclaimer, the term of this patent is extended or adjusted under 35 U.S.C. 154(b) by 1002 days.

(21) Appl. No.: 11/499,215

(22) Filed: Aug. 4, 2006

(65) Prior Publication Data

US 2008/0070170 A1 Mar. 20, 2008

(51) Int. Cl.
*F23N 5/10* (2006.01)

(52) U.S. Cl. ..... 431/80; 431/6; 431/18

(58) Field of Classification Search ..... 431/6, 431/25, 80, 18

See application file for complete search history.

(56) References Cited

U.S. PATENT DOCUMENTS

| | | | | | |
|---|---|---|---|---|---|
| 3,091,285 | A * | 5/1963 | Hassa | 431/54 |
| 4,318,687 | A * | 3/1982 | Inoue | 431/54 |
| 4,505,253 | A | 3/1985 | Mizuno et al. | |
| 4,516,930 | A * | 5/1985 | Dietz | 431/26 |
| 4,696,639 | A * | 9/1987 | Bohan, Jr. | 431/59 |
| 5,256,057 | A * | 10/1993 | Grow | 431/79 |
| 5,722,823 | A * | 3/1998 | Hodgkiss | 431/43 |
| 5,931,655 | A * | 8/1999 | Maher, Jr. | 431/14 |
| 7,044,729 | B2 * | 5/2006 | Ayastuy et al. | 431/25 |
| 7,088,253 | B2 * | 8/2006 | Grow | 340/578 |
| 7,314,370 | B2 * | 1/2008 | Chian et al. | 431/89 |
| 2006/0141409 | A1 * | 6/2006 | Chian et al. | 431/75 |
| 2006/0275720 | A1 * | 12/2006 | Hotton et al. | 431/80 |

* cited by examiner

*Primary Examiner*—Kenneth B Rinehart
*Assistant Examiner*—Daniel A Bernstein
(74) *Attorney, Agent, or Firm*—Tim L. Kitchen; Peter B. Scull; Berenbaum Weinshienk PC

(57) ABSTRACT

A safety valve supply circuit for the ignition of a gas burner is disclosed. Said safety valve is directly supplied by a flame-detecting thermocouple, and said supply circuit comprises a supply capacitor that is charged from an alternating mains voltage, obtaining from the energy accumulated in said supply capacitor, due to said charging, an input voltage signal that is used to temporarily supply said safety valve in order to maintain it open. Said charging of the supply capacitor is carried out by momentarily activating a supply switch to temporarily connect said supply capacitor to said alternating mains voltage, said supply switch activation occurring concurrently with the activation of the gas burner. Said supply circuit also comprises conditioning means for converting said input voltage signal into an output voltage signal that is directly applied to said safety valve to supply it, and so maintain it open.

18 Claims, 3 Drawing Sheets

SAFETY VALVE SUPPLY CIRCUIT FOR THE IGNITION OF A GAS BURNER

TECHNICAL FIELD

The present invention relates to auxiliary supply circuits for safety valves supplied by a thermocouple.

PRIOR ART

Safety valves supplied by thermocouples for their use in gas burners, for example, are known. The thermocouple keeps the safety valve open while there is a flame. In the event that the flame disappears the safety valve closes, thereby cutting the gas supply. The safety unit formed by the safety valve and the thermocouple creates an intrinsically safe device, as any type of fault in said safety unit causes the closure of the safety valve and cuts, therefore, the supply of gas.

These safety valves have the drawback that when the gas burner is ignited, a certain amount of time elapses until the thermocouple is capable of keeping the safety valve open by itself. A first solution to this drawback involves making the user, on operating the gas burner control in order to ignite it, keep said control pressed and thereby keep the safety valve open for enough time to allow the thermocouple to reach the minimum temperature necessary to enable it to keep the safety valve open while there is a flame.

A second solution involves adding an auxiliary supply circuit that provides the safety valve with the energy necessary for it to remain open when the gas burner is activated.

U.S. Pat. No. 4,505,253 discloses a water heater with a control circuit comprising a supply capacitor and a discharging circuit for said supply capacitor having a solenoid which operates a safety valve, also connected directly to a thermocouple. Said supply capacitor is used to temporarily feed said solenoid to temporarily supply said safety valve with the discharging energy of said supply capacitor, until the thermocouple is heat enough to activate itself the safety valve.

Said U.S. Pat. No. 4,505,253 also discloses a supply changeover switch which connects the supply capacitor to a D. C. voltage source in its rest position, said supply capacitor supplying the safety valve when said supply changeover switch is acted on. Said supply changeover switch has to remain activated until the thermocouple is capable of supplying the safety valve by itself, and a claw member is needed to maintain said supply changeover switch activated. Therefore, the safety circuit comprises an intermediate position for activating said supply changeover switch and a final position for activating the gas burner.

The supply capacitor disclosed in U.S. Pat. No. 4,505,253 is directly connected to the solenoid of the safety valve through a resistor, a supply capacitor with a very high capacity being necessary, with its inherent drawbacks (size, energy losses, . . . ).

DISCLOSURE OF THE INVENTION

It is an object of the invention to provide a supply circuit for a safety valve for the ignition of a gas burner that safeguards its own failures, that overcomes the refers drawbacks.

The supply circuit of the invention is used with safety valves that are supplied by a flame-detecting thermocouple. Said supply circuit comprises a supply capacitor that is charged from an alternating mains voltage, obtaining from the energy accumulated in said supply capacitor, due to said charging, an input voltage signal that is used to temporarily supply said safety valve in order to maintain it open. Said charging of the supply capacitor is carried out by momentarily activating a supply switch to temporarily connect the supply capacitor to said alternating mains voltage.

In its rest position, said supply switch is connected to said supply capacitor, so it is unnecessary to maintain said supply switch activated until the safety valve is kept in its valve open condition by the electric current from a thermocouple.

The activation of the supply switch occurs concurrently with the activation of the gas burner, so an intermediate position for activating said supply switch and a final position for activating the gas burner are unnecessary.

The supply circuit of the invention also comprises conditioning means for converting the input voltage signal into an output voltage signal that is directly applied to said safety valve to supply it, and so maintain it open. This avoids the drawback of needing a supply capacitor with a very high capacity.

These and other advantages and characteristics of the invention will be made evident in the light of the drawings and the detailed description thereof.

DETAILED DISCLOSURE OF THE INVENTION

Figure 1:
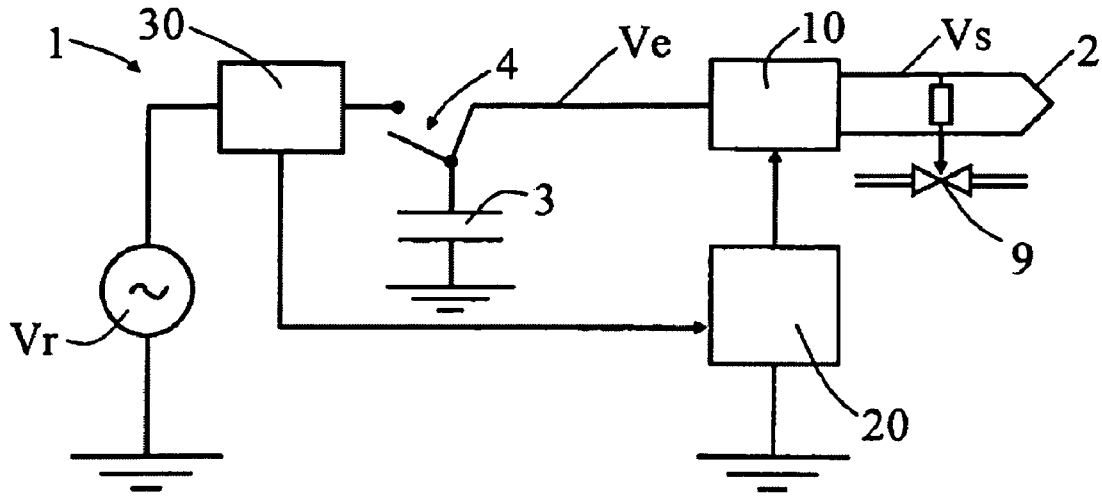
FIG. 1 is a schematic view of the supply circuit of the invention.

Referring to FIG. 1, a schematic view of the supply circuit 1 of the invention is shown. Said supply circuit 1 actuates a safety valve 9 which is powered by a flame-detecting thermocouple 2, and comprises conditioning means 10 for converting an input voltage signal Ve into an output voltage signal Vs that is capable of maintaining the safety valve 9 open. Said input voltage signal Ve is generated by an energy stored in a supply capacitor 3.

The supply capacitor 3 charges at the moment the gas burner is ignited. The supply circuit 1 comprises a supply switch 4 that connects said supply capacitor 3 with an alternating mains voltage Vr at the moment the user ignites the burner and disconnects it immediately after. More specifically, to activate the burner, the user presses a pushbutton (not shown in figures), using the supply switch 4 to connect said supply capacitor 3 to the alternating mains voltage Vr for the instant that the pushbutton remains pressed. In addition, supply circuit 1 comprises a spark generator (not shown in figures) that is also activated by said supply switch 4.

A rectifier and limiter block 30 is disposed between the supply capacitor 3 and the alternating mains voltage Vr, and it is used to charge said supply capacitor 3. With said block 30, said supply capacitor 3 is charged until a predetermined voltage.

Figure 2:
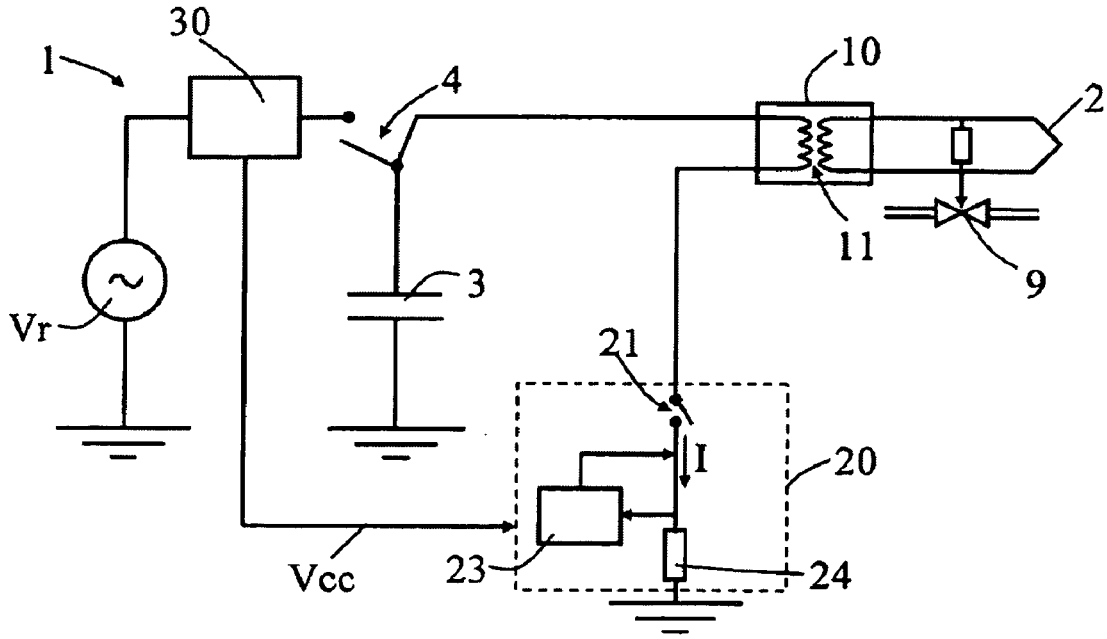
FIG. 2 is a schematic view of the supply circuit of FIG. 1, showing the conditioning means of said supply circuit.

The supply circuit 1 also comprises control means 20, preferably supplied from the rectifier and limiter block 30 with a DC voltage Vcc, which act on the conditioning means 10 for controlling the output voltage signal Vs, in order to obtain a substantially constant supply energy for the safety valve 9, when said safety valve 9 is supplied by the supply capacitor 3. With reference to FIG. 2, said control means 20 comprise a control switch 21 which is opened or closed for controlling said output voltage signal Vs, by means of an operating signal M.

The conditioning means 10 comprise a transformer 11, the input voltage signal Ve being the input signal of said transformer 11, and the output voltage signal Vs being obtained from the output signal of said transformer 11. When the control switch 21 is opened, during time intervals Toff, the circulation of a forward current I through the primary of said transformer 11 is prevented and the output voltage signal Vs becomes substantially null. Thus, as the charge of the supply capacitor 3 is decreasing and then said input voltage signal Ve is decreasing too, it is possible by means of said operating signal to operate on said control switch 21 to open or close it, in order to maintain a substantially constant supply energy for the safety valve 9.

The control means 20 also comprise detection means 23 which can detect the forward current I through the primary of the transformer 11, said control means 20 causing the opening of the control switch 21, by means of the operating signal M, when said detection means 23 determines that said forward current I has reached a specific value. As the charge of the supply capacitor 3 is decreasing and then the input voltage signal Ve is decreasing, the time at which the forward current I reaches its specific value is longer, so that the time that said control switch 21 remains open is longer too, being possible to maintain a substantially constant supply energy for the flame-detecting thermocouple 2.

A resistor 24 is disposed in series with the primary of the transformer 11. When there is a determined voltage between the terminals of said resistor 24, a current, substantially equal to the forward current I through said primary, of a specific value flows through said resistor 24. If the value of said resistor 24 is modified, said specific value of current changes, said specific value depending on the value of said resistor 24.

Figure 3:
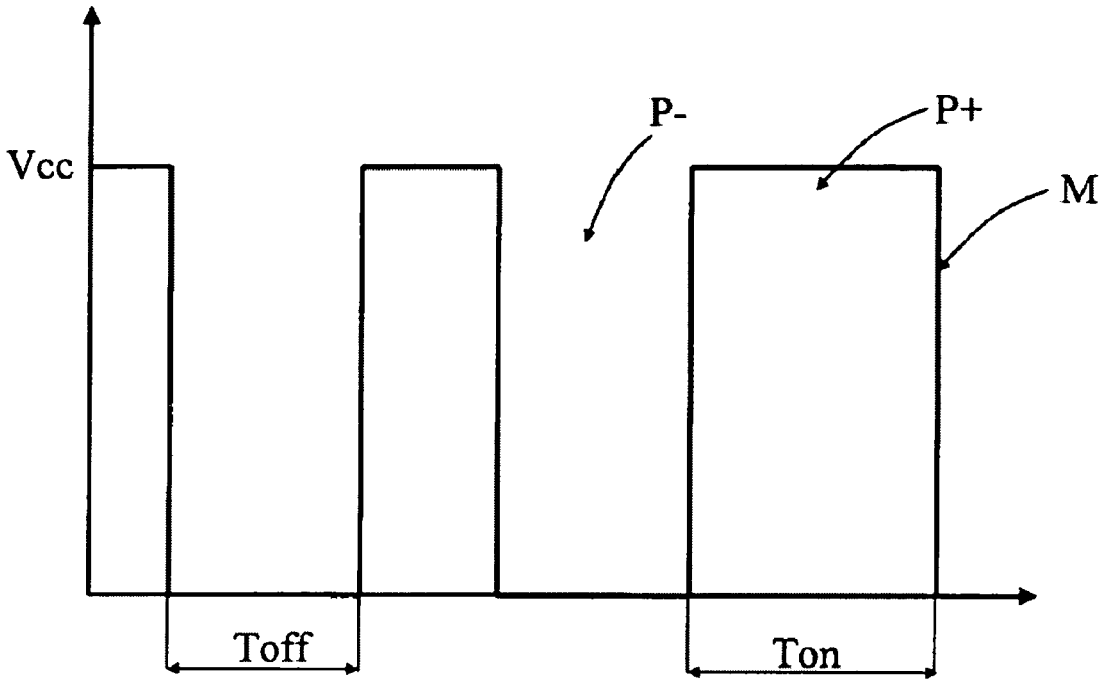
FIG. 3 shows an example of the operating signal generated by the supply circuit of FIG. 1.

Preferably, the operating signal M is a squared signal as shown in FIG. 3, whose frequency varies as the charge of the supply capacitor 3 decreases. The time intervals Toff in which the control switch 21 remains open correspond with the negative pulses P− of said squared signal, and time intervals Ton in which said control switch 21 remains closed correspond with the positive pulses P+ of said squared signal. Thus, as the time that said control switch 21 remains closes is longer while the charge of said supply capacitor decreases, said positive pulses P+ becomes longer as said charge decreases. Preferably, said control switch 21 comprises a transistor which is stopped directly, by means of said operating signal M, when said forward current I has reached said specific value.

Figure 4:
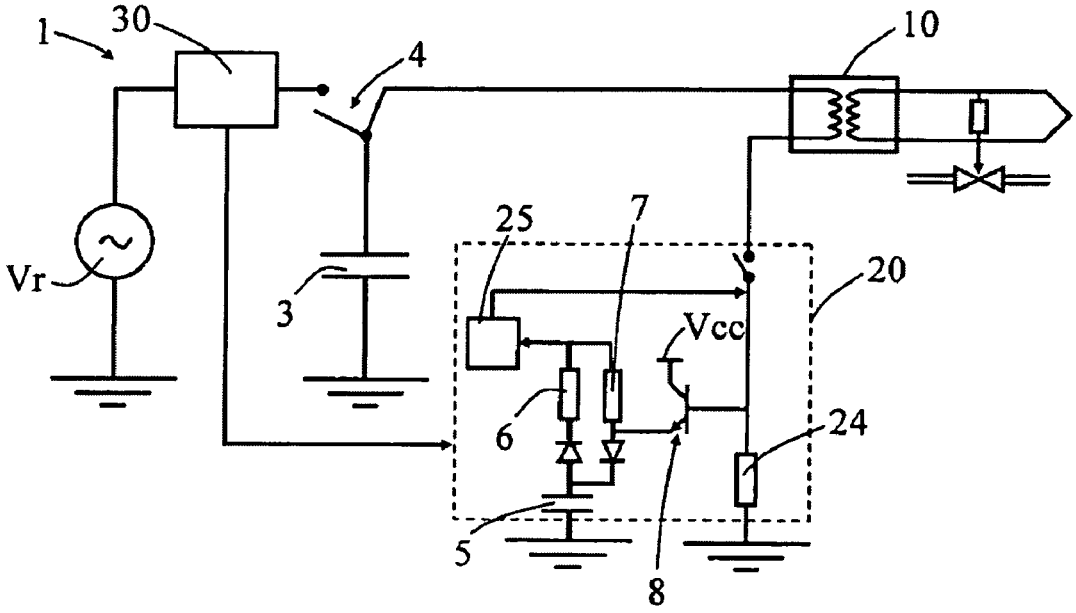
FIG. 4 is a schematic view of the supply circuit of FIG. 1, showing the signal generator of said supply circuit.

The operating signal M is generated by a signal generator 25 (for example, a timing circuit TLC555 from Texas Instruments), shown in FIG. 4, from the charge or discharge of an auxiliary capacitor 5. The positive pulse P+ extends until said auxiliary capacitor 5 is charged, and the negative pulse P− extends until said auxiliary capacitor 5 is discharged. Preferably, said auxiliary capacitor 5 is discharged through a discharging resistor 6, the discharging time being substantially constant, and then the time intervals Toff of said negative pulses P− being substantially constant. The charging circuit of said auxiliary capacitor 5 comprises a charging resistor 7, and the time of said charging can be modified by means of a charging transistor 8. When the forward current I has reached the specific value, said charging transistor 8 starts to direct, causing the charge of said auxiliary capacitor 5 ends, causing the positive pulse P+ of said operating signal M ends.

Figure 5:
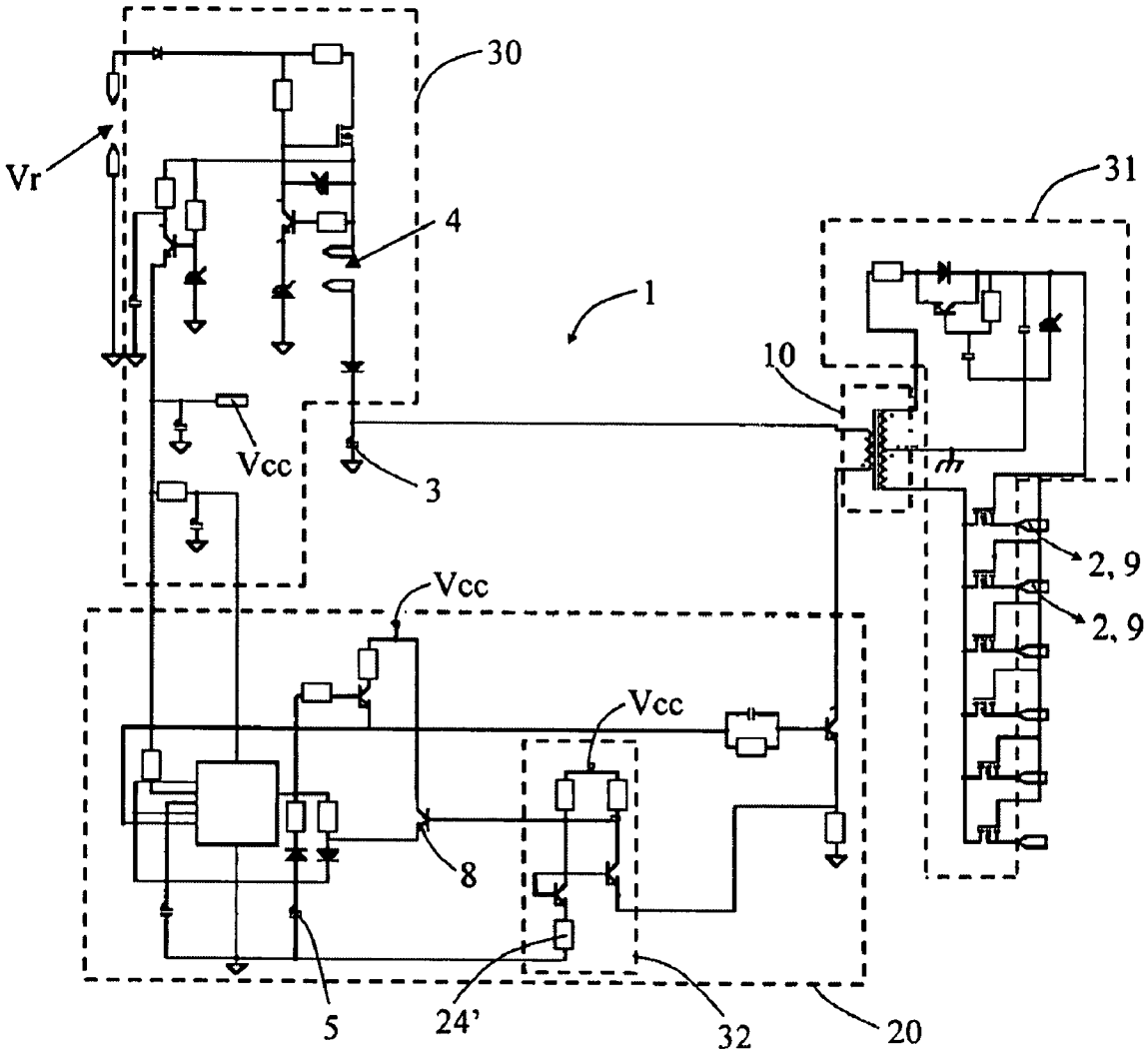
FIG. 5 shows an embodiment of the supply circuit of the invention.

An embodiment of the supply circuit 1 is shown in FIG. 5. Said supply circuit 1 is able to supply a plurality of safety valves 9, and the supply capacitor 3 charges when any of the burners is ignited. A rectifier block 31 is disposed between the transformer 11 and the safety valves 9, and receives the output signal from said transformer 11, generating the output voltage signal Vs that the corresponding safety valve 9 receives.

Thanks to a temperature compensating block 32, the positive pulse P+ is always finished when the forward current I through the primary of the transformer 11 is equal to the specific value in spite of the temperature of the supply circuit 1. For that purpose, said block 32 comprises a compensating resistor 24', said compensating resistor 24' having to be equal to the resistor 24.

What is claimed is:

1. A safety valve supply circuit for the ignition of a gas burner, said safety valve being directly supplied by a flame-detecting thermocouple, said supply circuit comprising a supply capacitor that is charged from an alternating mains voltage, obtaining from the energy accumulated in said supply capacitor, due to said charging, an input voltage signal that is used to temporarily supply said safety valve in order to maintain it open, said charging of the supply capacitor being carried out by momentarily activating a supply switch to temporarily connect the supply capacitor to said alternating mains voltage, said supply switch activation occurring concurrently with the activation of the gas burner, and said supply circuit also comprising conditioning means for converting said input voltage signal into an output voltage signal that is directly applied to said safety valve to supply it, and so maintain it open.

2. The supply circuit according to claim 1, wherein the supply capacitor is always connected to the conditioning means.

3. The supply circuit according to claim 1, wherein the conditioning means comprise a transformer, the input voltage signal being the input signal of said transformer and the output voltage signal being obtained from the output signal of said transformer, and said supply circuit comprises control means with a control switch disposed in series with said transformer, said control means generating an operating signal that can open said control switch to prevent a forward current from circulating through the primary of said transformer during determined time intervals as the charge of the supply capacitor decreases, so that, by means of said opening, said control means can control the value of the output voltage signal, in order to supply the safety valve a substantially constant energy.

4. The supply circuit according to claim 3, wherein the control means comprise detection means that can detect the forward current through the primary of the transformer, said control means causing the opening of the control switch with the operating signal, when said detection means detect that said forward current has reached a specific value.

5. The supply circuit according to claim 3, wherein the control switch comprises a transistor, causing said transistor to stop directing when the forward current has reached said specific value.

6. The supply circuit according to claim 4, wherein the operating signal is a squared signal of variable frequency and the time intervals correspond with the negative pulses of said squared signal, the positive pulse of said squared signal being completed when the detection means detect that the forward current has reached the specific value thereby opening the control switch, the duration of said positive pulses being greater as the charge of the supply capacitor decreases.

7. A power supply circuit for a solenoid gas safety valve of a gas burner comprising: a flame-detecting and voltage producing thermocouple electrically coupled to the solenoid of a solenoid gas safety valve and adapted to produce a voltage sufficient to cause the solenoid to hold the safety valve in an open position when the thermocouple is at a designated temperature, a supply capacitor connectable to an alternating mains voltage source via a switch when the switch is in a first position and connected to the solenoid and not the alternating mains voltage source when the switch is in a second position, a transformer electrically disposed in series between the solenoid and the capacitor when the switch is in the second position and adapted to receive an input voltage from the capacitor and to produce an output voltage which is sufficient to cause the solenoid to hold the safety valve in the open position.

8. A power supply circuit according to claim 7, wherein the transformer is directly connected to the solenoid.

9. A power supply circuit according to claim 7, wherein the storage capacity of the capacitor is sufficient to cause the solenoid to hold the safety valve in the open position for a period of time sufficient for the thermocouple to reach the designated temperature.

10. A power supply circuit according to claim 7, wherein the switch is configured to momentarily move to the first position concurrently with an activation of the gas burner and then to subsequently move to the second position.

11. A power supply circuit according to claim 7 further comprising a rectifier positioned electrically in series between the alternating mains voltage source and the capacitor when the switch is in the first position.

12. A power supply circuit according to claim 7, wherein the transformer comprises a primary winding and a secondary winding, the power supply circuit further comprising a control circuit coupled to the primary winding that is configured to act on the primary winding to control the output voltage of the transformer so that it remains substantially constant during a period of time when the charge of the capacitor is decreasing.

13. A power supply circuit according to claim 12 further comprising a rectifier positioned electrically in series between the alternating mains voltage source and the capacitor when the switch is in the first position, the control circuit and rectifier electrically coupled so that the rectifier provides a DC power voltage to the control circuit.

14. A power supply circuit according to claim 7 further comprising a rectifier block disposed between the transformer and the solenoid.

15. A safety valve supply circuit for the ignition of a gas burner, said safety valve being directly supplied by a flame-detecting thermocouple, said supply circuit comprising a supply capacitor that is charged from an alternating mains voltage, obtaining from the energy accumulated in said supply capacitor, due to said charging, an input voltage signal that is used to temporarily supply said safety valve in order to maintain it open, said charging of the supply capacitor being carried out by momentarily activating a supply switch to temporarily connect the supply capacitor to said alternating mains voltage, said supply switch activation occurring concurrently with the activation of the gas burner, and said supply circuit also comprising conditioning means for converting said input voltage signal into an output voltage signal that is directly applied to said safety valve to supply it, and so maintain it open, the conditioning means comprising a transformer, the input voltage signal being the input signal of said transformer and the output voltage signal being obtained from the output signal of said transformer, and said supply circuit comprising control means with a control switch disposed in series with said transformer, said control means generating an operating signal that can open said control switch to prevent a forward current from circulating through the primary of said transformer during determined time intervals as the charge of the supply capacitor decreases, so that, by means of said opening, said control means can control the value of the output voltage signal, in order to supply the safety valve a substantially constant energy.

16. The supply circuit according to claim 15, wherein the control means comprise detection means that can detect the forward current through the primary of the transformer, said control means causing the opening of the control switch with the operating signal, when said detection means detect that said forward current has reached a specific value.

17. The supply circuit according to claim 15, wherein the control switch comprises a transistor, causing said transistor to stop directing when the forward current has reached said specific value.

18. The supply circuit according to claim 16, wherein the operating signal is a squared signal of variable frequency and the time intervals correspond with the negative pulses of said squared signal, the positive pulse of said squared signal being completed when the detection means detect that the forward current has reached the specific value thereby opening the control switch, the duration of said positive pulses being greater as the charge of the supply capacitor decreases.

* * * * *